US010650718B2

(12) United States Patent
Chuang

(10) Patent No.: US 10,650,718 B2
(45) Date of Patent: May 12, 2020

(54) METHOD AND DISPLAY DEVICE FOR SUB -PIXEL RENDERING

(71) Applicant: HIMAX TECHNOLOGIES LIMITED, Tainan (TW)

(72) Inventor: Chi-Feng Chuang, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 56 days.

(21) Appl. No.: 15/976,881

(22) Filed: May 11, 2018

(65) Prior Publication Data

US 2019/0347973 A1 Nov. 14, 2019

(51) Int. Cl.
*G09G 3/20* (2006.01)

(52) U.S. Cl.
CPC ..... *G09G 3/2003* (2013.01); *G09G 3/2074* (2013.01); *G09G 3/2092* (2013.01); *G09G 2320/0666* (2013.01); *G09G 2320/0673* (2013.01)

(58) Field of Classification Search
CPC .. G09G 3/2074; G09G 3/2092; G09G 3/2003; G09G 2320/0673; G09G 2320/0666
See application file for complete search history.

(56) References Cited

U.S. PATENT DOCUMENTS

2011/0057950 A1* 3/2011 Kim ..... G09G 5/02 345/602
2015/0235587 A1* 8/2015 Su ..... G09G 3/2003 345/694
2016/0117969 A1* 4/2016 Qin ..... G09G 3/2003 345/694
2018/0190239 A1* 7/2018 Zhu ..... H04N 9/64

FOREIGN PATENT DOCUMENTS

CN 105609033 A 5/2016
CN 106791755 A 5/2017

* cited by examiner

*Primary Examiner* — Kwang-Su Yang
(74) *Attorney, Agent, or Firm* — CKC & Partners Co., LLC

(57) ABSTRACT

The sub-pixel rendering method includes: obtaining a digital image, in which the digital image includes multiple pixels, each of the pixels includes multiple grey levels, and the number of the grey levels in the digital image is greater than the number of the sub-pixel structures; performing a gamma transformation on each of the grey levels to obtain multiple sub-pixel luminances; performing a sub-pixel rendering algorithm on the sub-pixel luminances to obtain multiple rendered sub-pixel luminances; and transforming the rendered sub-pixel luminances into multiple rendered grey levels, and driving the display panel according to the rendered grey levels, in which the number of the rendered grey levels is equal to the number of the sub-pixel structures.

10 Claims, 7 Drawing Sheets

METHOD AND DISPLAY DEVICE FOR SUB -PIXEL RENDERING

BACKGROUND

Field of Invention

The present invention relates to a method and a display device of performing sub-pixel rendering in accordance with luminance.

Description of Related Art

In a conventional display panel, multiple sub-pixel structures are arranged as a matrix, and each sub-pixel structure renders one of red, green, and blue colors, and three sub-pixel structures of red, green, and blue constitute a pixel. However, in some panels, one pixel only includes two sub-pixel structures. For example, one pixel may only include one red sub-pixel structure and one green sub-pixel structure, and another pixel may only include one green sub-pixel structure and one blue sub-pixel structure. It is an issue in the art about how to correctly render a digital image in this kind of panels.

SUMMARY

Embodiments of the present invention provide a sub-pixel rendering method for display panel including multiple sub-pixel structures. The sub-pixel rendering method includes: obtaining a digital image, in which the digital image includes multiple pixels, each of the pixels includes multiple grey levels, and the number of the grey levels in the digital image is greater than the number of the sub-pixel structures; performing a gamma transformation on each of the grey levels to obtain multiple sub-pixel luminances; performing a sub-pixel rendering algorithm on the sub-pixel luminances to obtain multiple rendered sub-pixel luminances; and transforming the rendered sub-pixel luminances into multiple rendered grey levels, and driving the display panel according to the rendered grey levels, in which the number of the rendered grey levels is equal to the number of the sub-pixel structures.

In some embodiments, each of the grey level corresponds to one of multiple colors, each of the sub-pixel structures corresponds to one of the colors, and the colors includes red, blue, and green. The sub-pixel rendering method further includes: for each of the colors, obtaining a color ratio of the number of the sub-pixel structures to a number of the pixels.

In some embodiments, the sub-pixel luminances include a first sub-pixel luminance and a second sub-pixel luminance next to the first sub-pixel luminance. The second sub-pixel luminance and the first sub-pixel luminance correspond to the same color. The step of performing the sub-pixel rendering algorithm on the sub-pixel luminances includes: performing a weighting sum on the first sub-pixel luminance and the second sub-pixel luminance according to the color ratio corresponding to the first sub-pixel luminance to obtain the rendered sub-pixel luminance corresponding to the first sub-pixel luminance.

In some embodiments, the gamma transformation is performed according to a following equation (1).

$$L_{c,p}=(I_{c,p})^{\alpha} \tag{1}$$

In the equation (1), c is one of the colors, $I_c$ is the grey level corresponding to the color c and a position p, $L_c$ is the sub-pixel luminance corresponding to the color c and the position p, and $\alpha$ is a real number.

In some embodiments, the sub-pixel rendering algorithm is performed according to a following equation (2).

$$L_{c,p}'=\beta_c\times L_{c,p}+(1-\beta_c)\times L_{c,N(p)} \tag{2}$$

In the equation (2), $\beta_c$ is the color ratio corresponding to the color c, N(p) is a position next to the position p, and $L_{c,p}'$ is the rendered sub-pixel luminance corresponding to the color c and the position p.

In some embodiments, the step of transforming the rendered sub-pixel luminances into the rendered grey levels is performed according to a following equation (3), in which $I_{c,p}'$ is the rendered grey level corresponding to the color c and the position p.

$$I'_{c,p}=(L'_{c,p})^{\frac{1}{\alpha}} \tag{3}$$

From another aspect, embodiments of the invention provide a display device including a display panel and a computation circuit. The display panel includes multiple sub-pixel structures. The computation circuit is configured to obtain a digital image including multiple pixels, in which each of the pixels includes multiple grey levels, and a number of the grey levels in the digital image is greater than a number of the sub-pixel structures. The computation circuit is configured to perform a gamma transformation on each of the grey levels to obtain multiple sub-pixel luminances, perform a sub-pixel rendering algorithm on the sub-pixel luminances to obtain multiple rendered sub-pixel luminances, transform the rendered sub-pixel luminances into multiple rendered grey levels, and drive the display panel according to the rendered grey levels. The number of the rendered grey levels is equal to the number of the sub-pixel structures.

In some embodiments, each of the grey levels corresponds to one of multiple colors, each of the sub-pixel structures corresponds to one of the colors that include red, blue, and green. The computation circuit is further configured to obtain a color ratio of the number of the sub-pixel structures to a number of the pixels for each of the colors.

In some embodiments, the sub-pixel luminances include a first sub-pixel luminance and a second sub-pixel luminance next to the first sub-pixel luminance. The second sub-pixel luminance and the first sub-pixel luminance correspond to the same one of the colors. The computation circuit is further configured to perform a weighting sum on the first sub-pixel luminance and the second sub-pixel luminance according to the color ratio corresponding to the first sub-pixel luminance to obtain the rendered sub-pixel luminance corresponding to the first sub-pixel luminance.

In some embodiments, the computation circuit performs the gamma transformation according to the equation (1).

In some embodiments, the computation circuit performs the sub-pixel rendering algorithm according to the equation (2).

In some embodiments, the computation circuit transforms the rendered sub-pixel luminances into the rendered grey levels according to the equation (3).

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size.

The using of "first", "second", "third", etc. in the specification should be understood for identifying units or data described by the same terminology, but are not referred to particular order or sequence.

Figure 1:
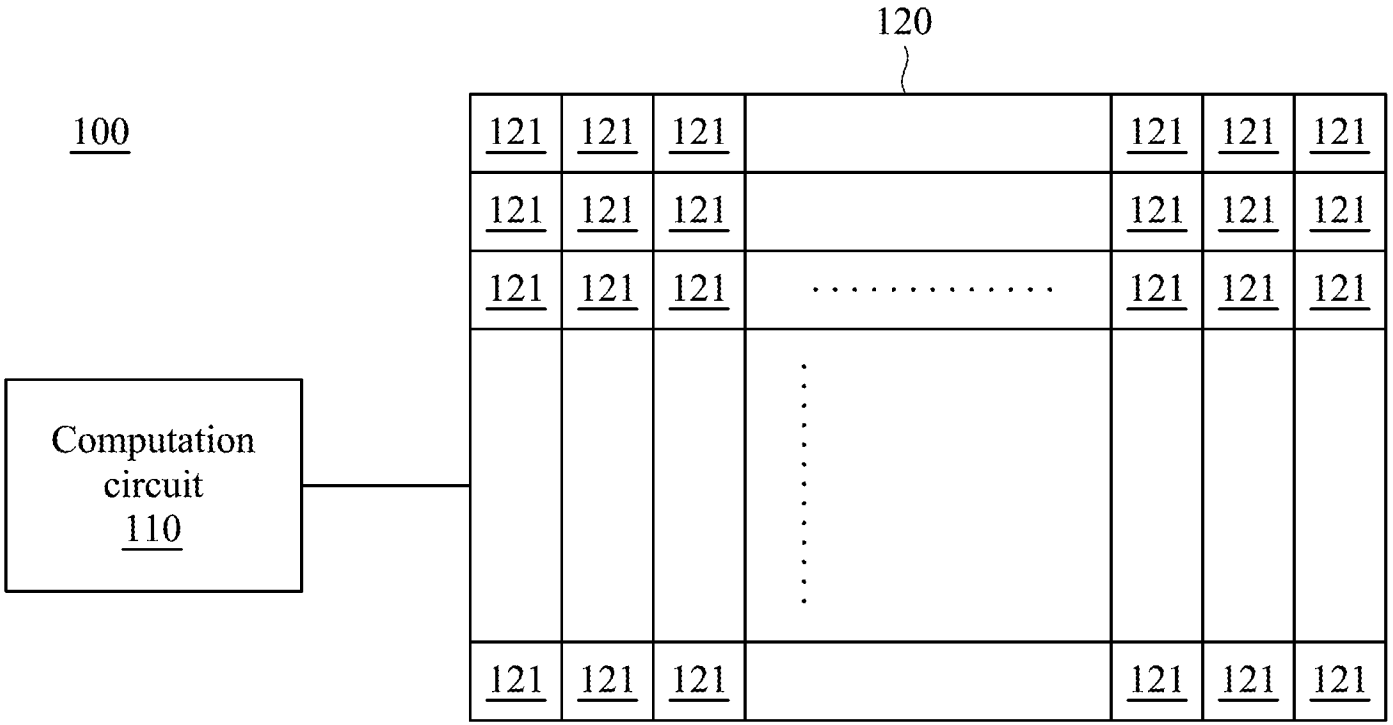
FIG. 1 is a schematic diagram illustrating a display device in accordance with an embodiment.

FIG. 1 is a schematic diagram illustrating a display device in accordance with an embodiment. Referring to FIG. 1, a display device 100 includes a computation circuit 110 and a display panel 120. The computation circuit 110 obtains a digital image and generate grey levels for the display panel 120. The computation circuit 110 may be a timing controller, a digital image processor, an application-specific integrated circuit, or any suitable circuit disposed in the display device 100. The display panel 120 includes multiple sub-pixel structures 121. The display panel 120 may be a liquid crystal display panel or an organic light emitting display panel, which is not limited in the invention.

The digital image obtained by the computation circuit 110 includes multiple pixels. Each pixel includes multiple grey levels, and each grey level corresponds to one of colors which may include red, green, and blue. Each sub-pixel structure 121 also corresponds to one of the colors. In particular, different from a conventional display device in which one pixel corresponds to three sub-pixel structures, one pixel corresponds to two or less sub-pixel structures in this embodiment. For example, if the digital image has M rows and N columns where M and N are positive integers, then there are M×N×3 sub-pixel structures in the conventional display panel, but there are M×N×2 sub-pixel structures in this embodiment. In other words, the number of the grey levels in the digital image is greater than the number of the sub-pixel structures 121 because each pixel of the digital image includes three grey levels and each pixel only corresponds to two sub-pixel structures 121.

Figure 2A:
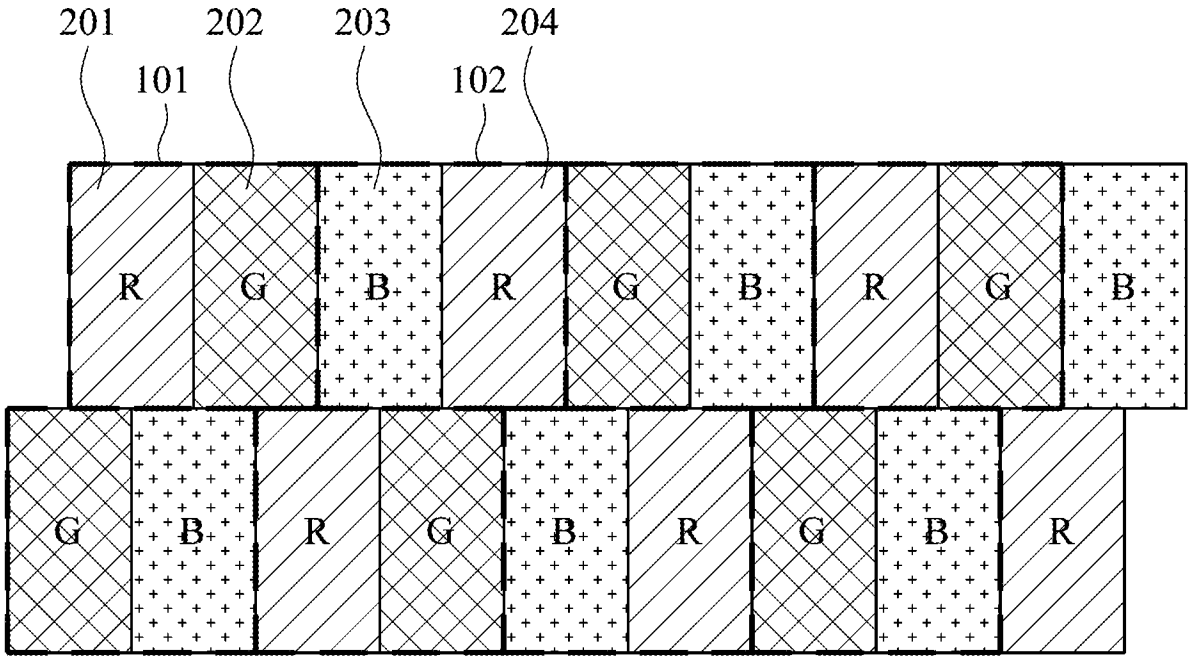
FIG. 2A to FIG. 2E are schematic diagrams illustrating colors of the sub-pixel structures in the display panel in accordance with some embodiments.
Figure 2B:
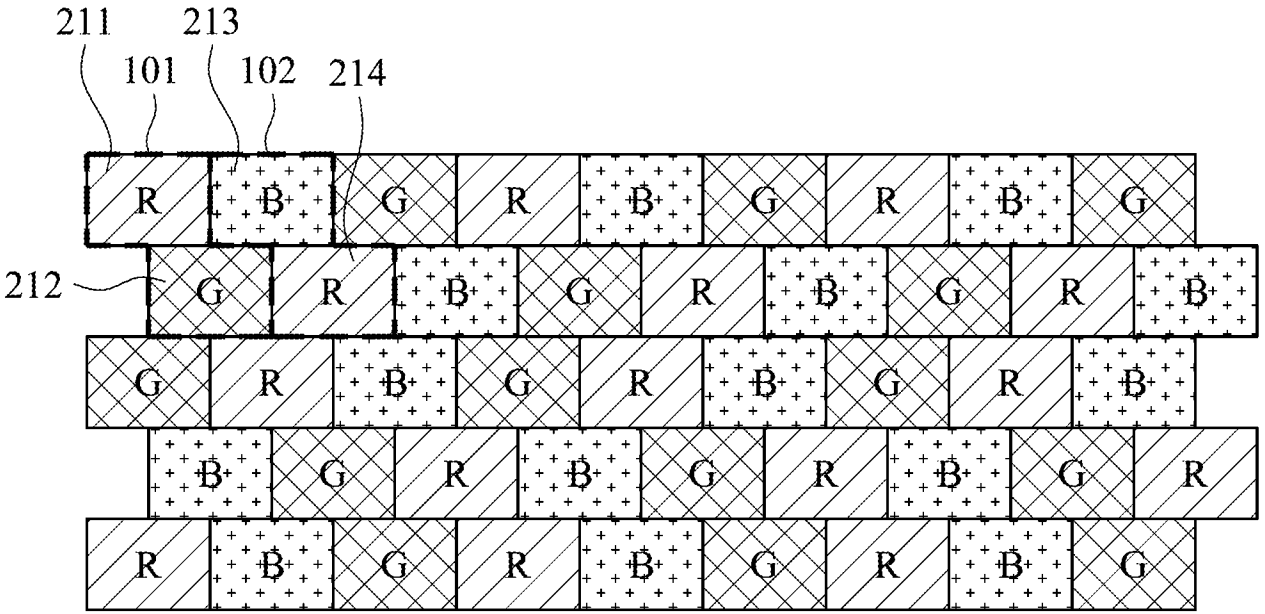
Figure 2C:
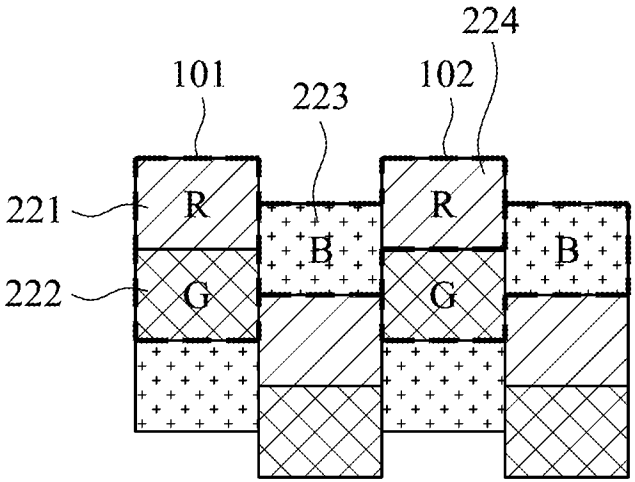
Figure 2D:
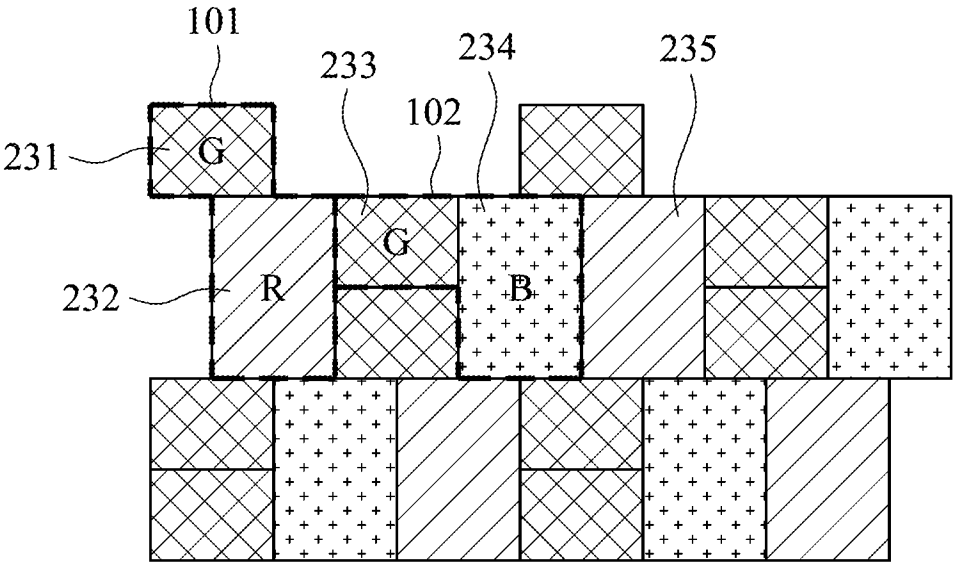
Figure 2E:
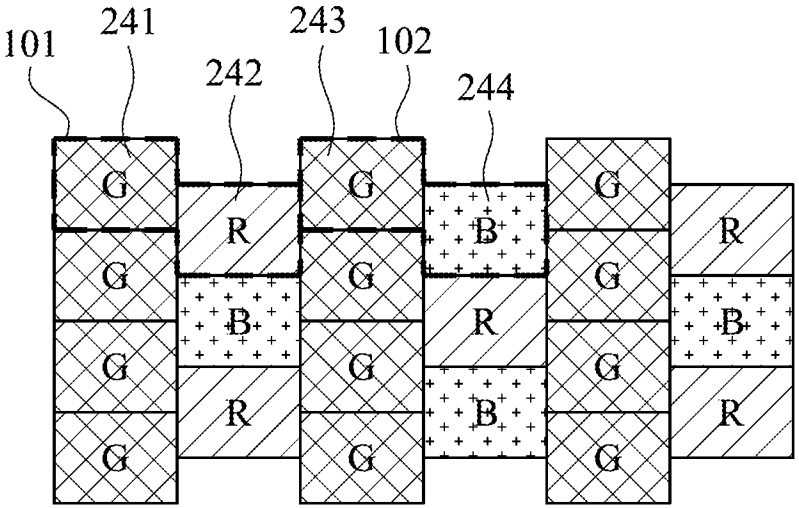

FIG. 2A to FIG. 2E are schematic diagrams illustrating colors of the sub-pixel structures in the display panel in accordance with some embodiments. In the embodiments of FIG. 2A to FIG. 2E, only colors and relative position of the sub-pixel structures are shown for simplification, in which R, G, and B represent red, green, and blue respectively. Two sub-pixel structures surrounded by dash lines correspond to the same pixel. For example, in FIG. 2A, red and green sub-pixel structures 201, 202 correspond to a pixel 101, and blue and red sub-pixel structures 203, 204 correspond to a pixel 102. In the embodiment of FIG. 2B, red and blue sub-pixel structures 211, 212 correspond to the pixel 101, and blue and red sub-pixel structures 213, 214 correspond to the pixel 102. In the embodiment of FIG. 2C, red and green sub-pixel structures 221, 222 correspond to the pixel 101, and blue and red sub-pixel structures 223, 224 correspond to the pixel 102. In FIG. 2D, green and red sub-pixel structures 231, 232 correspond to the pixel 101, and green and blue sub-pixel structures 233, 234 correspond to the pixel 102. In FIG. 2E, green and red sub-pixel structures 241, 242 correspond to the pixel 101, and green and blue sub-pixel structures 243, 244 correspond to the pixel 102. In some embodiments, two sub-pixel structures corresponding to the same pixel may be disposed on the same scan line or on two different scan lines, and/or disposed on the same data line or different data lines. People skilled in the technical field should be able to devise a display panel with other arrangement, and the arrangement of the sub-pixel structures in the display panel 120 is not limited in the invention.

As shown in the embodiments of FIG. 2A to FIG. 2E, the number of the sub-pixel structures for different colors may be the same or different from each other. For example, the numbers of red, green, and blues sub-pixel structures are equal to each other in the embodiments of FIG. 2A to FIG. 2C, but the number of green sub-pixel structures is greater than the numbers of red and blue sub-pixel structures in the embodiments of FIG. 2D and FIG. 2E. The ratio of the number of the sub-pixel structures for each color to the number of the pixels in the digital images is referred to a respective color ratio. For example, the red, green, and blue color ratios are all ⅔ in the embodiments of FIG. 2A to FIG. 2C; and the green color ratio is 1, and the red and blue color ratios are equal to ½ in the embodiments of FIG. 2D to FIG. 2E. The color ratios may have different values in other embodiments depending on the design of the display panel 120, and the values of the color ratios are not limited in the invention.

In the embodiment, the grey levels are transformed into luminances before a sub-pixel rendering algorithm is performed, and the luminances are transformed back to grey levels after the sub-pixel rendering algorithm is performed. If the sub-pixel rendering algorithm is performed according to the grey levels, a situation of color bleeding may occur because the grey levels do not represent real luminance.

Figure 3:
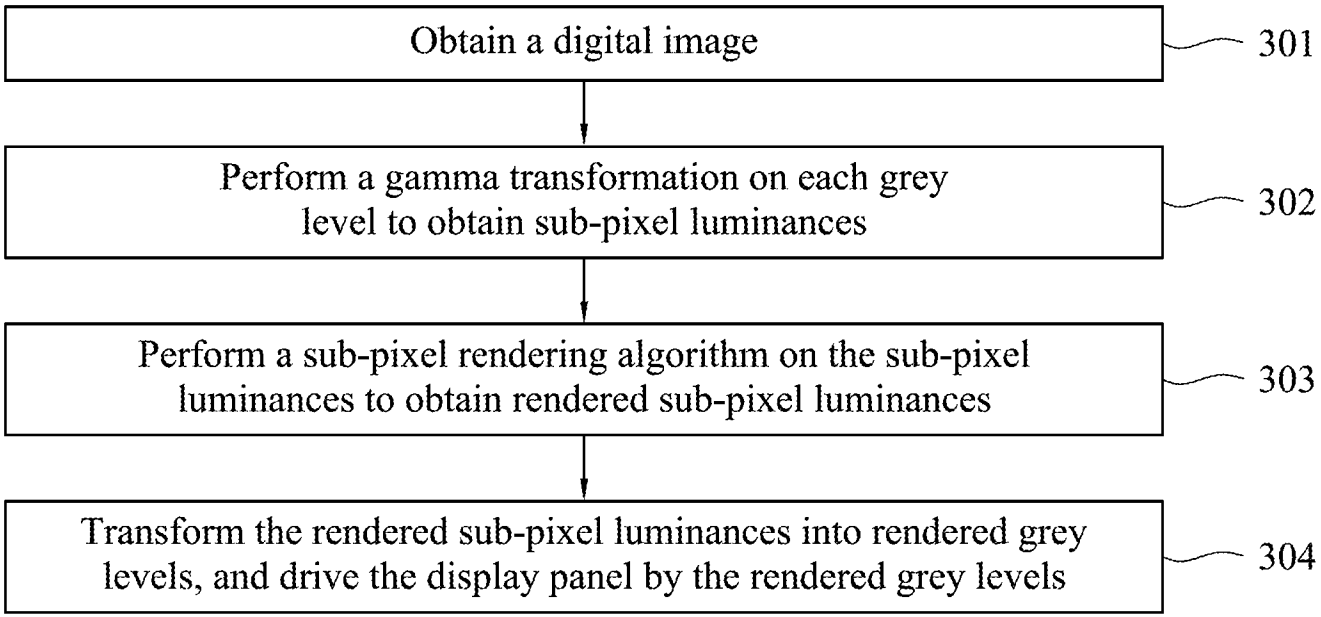
FIG. 3 is a flow chart of a sub-pixel rendering method in accordance with an embodiment.

FIG. 3 is a flow chart of a sub-pixel rendering method in accordance with an embodiment. Referring to FIG. 3, in step 301, a digital image is obtained. As described above, the digital image includes multiple pixels. Each pixel includes multiple grey levels, and the number of the grey levels in the digital image is greater than the number of the sub-pixel structures 121.

In step 302, a gamma transformation is performed on each grey level to obtain multiple sub-pixel luminances. To be specific, the step 302 is performed according to the following equation (1).

$$L_{c,p}=(I_{c,p})^{\alpha} \tag{1}$$

In the equation (1), c is a color which may be red, green or blue. p is a position of a pixel. $I_{c,p}$ is the grey level corresponding to the color c and the position p. $L_{c,p}$ is the sub-pixel luminance corresponding to the color c and the position p. $\alpha$ is a real number such as 2.2, which is not limited in the invention.

In step 303, a sub-pixel rendering algorithm is performed on the sub-pixel luminances to obtain multiple rendered sub-pixel luminances. The content of the sub-pixel rendering algorithm is not limited in the invention, and one possible approach is provided below. In some embodiments, a weighting sum is performed on two neighboring sub-pixel luminances with same color according to the color ratio, so as to obtain the rendered sub-pixel luminances. In other words, if a first sub-pixel luminance is next to a second sub-pixel luminance, and they both correspond to the same color, then the weighting sum is performed on the first sub-pixel luminance and the second sub-pixel luminance according to the color ratio corresponding to the first sub-pixel luminance so as to obtain the rendered sub-pixel luminance corresponding to the first sub-pixel luminance. To be specific, the sub-pixel rendering algorithm may be performed according to the following equation (2).

$$L_{c,p}'=\beta_c \times L_{c,p}+(1-\beta_c)\times L_{c,N(p)} \quad (2)$$

$\beta_c$ is the color ratio corresponding to the color c. N(p) is a position next to the position p. $L_{c,p}'$ is the rendered sub-pixel luminance corresponding to the color c and the position p. Take FIG. 2A as an example, the rendered sub-pixel luminance corresponding to the sub-pixel structure 204 is calculated according to the following equation (3).

$$L_{r,p}'=\tfrac{2}{3}\times L_{r,p}+\tfrac{1}{3}\times L_{r,N(p)} \quad (3)$$

In the example of FIG. 2A, the red color ratio is ⅔, $L_{r,p}$ is the sub-pixel luminance corresponding to the sub-pixel structure 204, and $L_{r,N(p)}$ is the sub-pixel luminance corresponding to the sub-pixel structure 201. The sub-pixel structure 204 is the horizontally closest sub-pixel structure to the sub-pixel structure 201 with the same color. In the embodiment, N(p) is the position at the left, but it may be the position at the top, bottom, right or another neighboring position along other directions, which is not limited in the invention.

Take FIG. 2D as another example, the rendered sub-pixel luminance corresponding to the sub-pixel structure 233 is calculated according to the following equation (4). Note that the green color ratio is 1 in the embodiment of FIG. 2D.

$$L_{g,p}'=L_{g,p} \quad (4)$$

In addition, the rendered sub-pixel luminance corresponding to the sub-pixel structure 235 is calculated according to the following equation (5).

$$L_{r,p}'=\tfrac{1}{2}\times L_{r,p}+\tfrac{1}{2}\times L_{r,N(p)} \quad (5)$$

In the example of FIG. 2D, the red color ratio is ½, $L_{r,p}$ is the sub-pixel luminance corresponding to the sub-pixel structure 235, and $L_{r,N(p)}$ is the sub-pixel luminance corresponding to the sub-pixel structure 232.

Referring to FIG. 3, in step 304, the rendered sub-pixel luminances are transformed into multiple rendered grey levels, and display panel 120 is driven by the rendered grey levels. To be specific, the step of transformation is performed according to the following equation (6).

$$I'_{c,p}=(L'_{c,p})^{\frac{1}{\alpha}} \quad (6)$$

$I_{c,p}'$ is the rendered grey level corresponding to the color c and the position p. Note that if a pixel does not correspond to green (blue or red) sub-pixel structure, then the green (blue or red) rendered grey level will be discarded. For example, in the embodiment of FIG. 2A, the pixel 101 does not correspond to blue sub-pixel structure, and therefore the blue rendered grey level of the pixel 101 will be discarded. As a result, the number of all rendered grey levels is equal to the number of all sub-pixel structures 121. In some embodiments, the computation circuit 110 may transmit the rendered grey levels to a source driver which transforms the rendered grey level into voltages and applies the voltages on the corresponding data lines. However, how the display panel is driven is not limited in the invention. The steps in FIG. 3 can be implemented as program codes or circuits, and other steps may be inserted between the steps of the FIG. 3, which is not limited in the invention.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display device, comprising:

a display panel comprising a plurality of sub-pixel structures; and a computation circuit configured to obtain a digital image comprising a plurality of pixels, wherein each of the pixels comprises a plurality of grey levels, each of the grey levels corresponds to one of a plurality of colors, each of the sub-pixel structures corresponds to one of the colors, the colors comprises red, blue, and green, and a number of the grey levels in the digital image is greater than a number of the sub-pixel structures, wherein for each of the colors, the computation circuit is configured to obtain a color ratio of the number of the corresponding sub-pixel structures to a number of the pixels, and wherein the computation circuit is configured to perform a gamma transformation on each of the grey levels to obtain a plurality of sub-pixel luminances, perform a sub-pixel rendering algorithm on the sub-pixel luminances to obtain a plurality of rendered sub-pixel luminances, transform the rendered sub-pixel luminances into a plurality of rendered grey levels, and drive the display panel according to the rendered grey levels, wherein a number of the rendered grey levels is equal to the number of the sub-pixel structures.

2. The display device of claim 1, wherein the sub-pixel luminances comprise a first sub-pixel luminance and a second sub-pixel luminance next to the first sub-pixel luminance, and the second sub-pixel luminance and the first sub-pixel luminance correspond to a same one of the colors, and wherein the computation circuit is further configured to perform a weighting sum on the first sub-pixel luminance and the second sub-pixel luminance according to the color ratio corresponding to the first sub-pixel luminance to obtain the rendered sub-pixel luminance corresponding to the first sub-pixel luminance.

3. The display device of claim 1, wherein the computation circuit performs the gamma transformation according to a following equation (1):

$$L_{c,p}=(I_{c,p})^{\alpha} \quad (1)$$

wherein c is one of the colors, p is a position of a pixel, $I_{c,p}$ is the grey level corresponding to the color c and the position p, $L_{c,p}$ is the sub-pixel luminance corresponding to the color c and the position p, and α is a real number.

4. The display device of claim 3, wherein the computation circuit performs the sub-pixel rendering algorithm according to a following equation (2):

$$L_{c,p}'=\beta_c \times L_{c,p}+(1-\beta_c)\times L_{c,N(p)} \quad (2)$$

wherein $\beta_c$ is the color ratio corresponding to the color c, N(p) is a position next to the position p, $L_{c,p}'$ is the rendered sub-pixel luminance corresponding to the color c and the position p.

5. The display device of claim 4, wherein the computation circuit transforms the rendered sub-pixel luminances into the rendered grey levels according to a following equation (3):

$$I'_{c,p} = (L'_{c,p})^{\frac{1}{a}} \quad (3)$$

wherein $I_{c,p}'$ is the rendered grey level corresponding to the color c and the position p.

6. A sub-pixel rendering method for a display panel, wherein the display panel comprises a plurality of sub-pixel structures, the sub-pixel rendering method comprising:

obtaining a digital image, wherein the digital image comprises a plurality of pixels, each of the pixels comprises a plurality of grey levels, each of the grey levels corresponds to one of a plurality of colors, each of the sub-pixel structures corresponds to one of the colors, the colors comprises red, blue, and green, and a number of the grey levels in the digital image is greater than a number of the sub-pixel structures;

for each of the colors, obtaining a color ratio of the number of the corresponding sub-pixel structures to a number of the pixels;

performing a gamma transformation on each of the grey levels to obtain a plurality of sub-pixel luminances;

performing a sub-pixel rendering algorithm on the sub-pixel luminances to obtain a plurality of rendered sub-pixel luminances; and transforming the rendered sub-pixel luminances into a plurality of rendered grey levels, and driving the display panel according to the rendered grey levels, wherein a number of the rendered grey levels is equal to the number of the sub-pixel structures.

7. The sub-pixel rendering method of claim 6, wherein the sub-pixel luminances comprise a first sub-pixel luminance and a second sub-pixel luminance next to the first sub-pixel luminance, the second sub-pixel luminance and the first sub-pixel luminance correspond to a same one of the colors, and the step of performing the sub-pixel rendering algorithm on the sub-pixel luminances comprises:

performing a weighting sum on the first sub-pixel luminance and the second sub-pixel luminance according to the color ratio corresponding to the first sub-pixel luminance to obtain the rendered sub-pixel luminance corresponding to the first sub-pixel luminance.

8. The sub-pixel rendering method of claim 6, wherein the gamma transformation is performed according to a following equation (1):

$$L_{c,p}=(I_{c,p})^{\alpha} \quad (1)$$

wherein c is one of the colors, p is a position of a pixel, $I_{c,p}$ is the grey level corresponding to the color c and the position p, $L_{c,p}$ is the sub-pixel luminance corresponding to the color c and the position p, and a is a real number.

9. The sub-pixel rendering method of claim 8, wherein the sub-pixel rendering algorithm is performed according to a following equation (2):

$$L_{c,p}'=\beta_c \times L_{c,p}+(1-\beta_c)\times L_{c,N(p)} \quad (2)$$

wherein $\beta_c$ is the color ratio corresponding to the color c, N(p) is a position next to the position p, $L_{c,p}'$ is the rendered sub-pixel luminance corresponding to the color c and the position p.

10. The sub-pixel rendering method of claim 9, wherein the step of transforming the rendered sub-pixel luminances into the rendered grey levels is performed according to a following equation (3):

$$I'_{c,p} = (L'_{c,p})^{\frac{1}{a}} \quad (3)$$

wherein $I_{c,p}'$ is the rendered grey level corresponding to the color c and the position p.

* * * * *